United States Patent [19]

Held

[11] 4,043,266

[45] Aug. 23, 1977

[54] HOLLOW CHARGE CONSTRUCTION AND METHOD OF FORMING A HOLLOW CHARGE LINING

[75] Inventor: Manfred Held, Aresing, Germany

[73] Assignee: Messerschmitt-Bolkow-Blohm GmbH, Germany

[21] Appl. No.: 660,178

[22] Filed: Feb. 23, 1976

[30] Foreign Application Priority Data

Feb. 26, 1975 Germany ..... 2508270

[51] Int. Cl.[2] ..... F42B 3/08

[52] U.S. Cl. ..... 102/24 HC; 102/56 SC

[58] Field of Search ..... 102/24 HC, 56 SC, 67

[56] References Cited

U.S. PATENT DOCUMENTS

| | | | |
|---|---|---|---|
| 3,000,309 | 9/1961 | Zapf | 102/67 |
| 3,491,694 | 1/1970 | Fountain | 102/67 |
| 3,757,693 | 9/1973 | Shea | 102/67 |

FOREIGN PATENT DOCUMENTS

| | | | |
|---|---|---|---|
| 1,812,462 | 10/1969 | Germany | 102/67 |

*Primary Examiner*—Verlin R. Pendegrass

*Attorney, Agent, or Firm*—McGlew and Tuttle

[57] ABSTRACT

A lining for a hollow charge is formed by making impressions into a plate to form a multiplicity of impressions in longitudinally extending and transversely extending rows. The impressions of at least some of the rows are made into geometrical form, such as, hexagons or rectangles, with geometrical impressions or forms therein having center axes which are offset in adjacent rows. In one embodiment, the center axes of the geometrical forms of some rows are located along an imaginary projection line and those of other rows are arranged along an imaginary projection line which is at an angle to the first line, preferably, the separate lines being arranged on each side of a radial line and defining an angle with the radial line which has a ratio with the radial sector between adjacent radial lines between the two imaginary lines which is in the ratio of 1 : 2. The impressions may be rectangular in nature and the centers of alternate rows aligned along a radial line which makes an angle with an imaginary line containing the centers of the other rows. The overall configuration of the impressions may be rectangular, hexagonal, etc.

13 Claims, 5 Drawing Figures

HOLLOW CHARGE CONSTRUCTION AND METHOD OF FORMING A HOLLOW CHARGE LINING

FIELD AND BACKGROUND OF THE INVENTION

This invention relates in general to the construction of explosive charges and, in particular, to a new and useful projectile-forming charge covering or lining having a multiplicity of hollow charge plate formations, and to a method of making such a lining.

DESCRIPTION OF THE PRIOR ART

The present invention is concerned with a process for the production of hollow charge linings, plate charge coverings or projectile-forming charge coverings, and particularly, the linings or coverings of which several are arranged in several layers on the circumference of explosive charges. For combatting easily damaged large-surface targets, such as airplanes, a warhead is used frequently whose explosive charges have a plurality of identifiable hollow charge lining portions or plate charge coverings. In the production of these warheads, it is known to prefabricate the linings and coverings, and the perforated charge casing in separate operations from different materials and to use the linings and the coverings in the casing openings provided for them and to weld them subsequently with the casing construction. During the welding, the structure of the lining or covering materials undergoes changes due to the generation of heat. Accordingly, it requires time-consuming annealing treatments to eliminate these structural changes. In addition, there are difficulties with contact stresses and special corrosion effects in cases where parts of different materials are joined with each other in the same or similar manner.

Among the known production measures is the cementing of prefabricated hollow charge linings, plate charge coverings or projectile-forming coverings into a lattice-type frame adapted to the outer contour of the respective warhead charge. A disadvantage, however, is the considerable production costs. In addition, mountings must be provided when the linings or coverings are cemented into the frame. In addition, special costly adhesives are required, namely, those adhesives which are compatible with the explosive and which can withstand all temperature stresses at the prescribed environmental tests. Obviously, all of these things make the production costs extremely high.

SUMMARY OF THE INVENTION

The invention provides a simple process which permits a reduction in the expenditure of machines, material and time, and thus the production costs in the formation of several hollow charge linings, plate charge coverings or projectile-forming charge coverings on the circumference of a warhead or similar ammunition.

In accordance with the invention, an explosive charge casing which bridges the regions of the respective explosive charge which must be covered is provided with a plurality of impressions or hollow charge indentation surfaces in the areas which will abridge the explosive charge material. With the invention, it is not necessary to join individual linings into an overall plate structure by welding or cementing the linings thereto but, instead, the hollow charge formations are formed directly into the casing structure to be employed. Instead, the linings themselves are transformed by forces which direction can be controlled and in order to form the hollow charge configurations. A feature of the method is that the indentations may be formed in a manner such that the axial direction or axial centers of the individual hollow charge formations or linings may be accurately positioned. In the preferred arrangement, a plurality of rows of hollow charge linings are formed in both circumferential and longitudinal directions. Each hollow charge indentation is of a precise geometrical configuration and the centers of the configurations are offset in adjacent rows so that each lining of each row in a longitudinal direction will have a different axial direction than the next adjacent lining of the same row. By the precision orientation of the individual axes of the hollow charge liner forms, it is possible to orient the manner in which the explosive thorns will form and be hurled during explosion of the charge toward the target. This may also permit the taking into account of the nature of the explosive charge and the overall structure and its position with respect to the possibility that it might hit a target upon impact. Thus, if high barb or thorn projectile densities are important in the space around the explosive charge in planes extending perpendicular to the longitudinal axis of the explosive charge, two procedures can be used independently of each other or jointly. First, it is possible to reduce the distance between the rows of the linings or coverings in favor of a greater number of rows. However, there is a limit to this reduction of the distance, namely, when the lining or covering bases of adjoining rows, for example, which form a chessboard or a honeycomb pattern, abut with their outlines. The second possibility can be used beyond the first-mentioned limit and with this possibility, there would be an increase of an effective number of rows at the expense of the number of linings or covering surfaces per row. This is done in view of an economical manufacture of the device.

In a simple explosive charge with a cylindrical cross-section, in accordance with the invention, the lining or covering surfaces of one group of hollow charge liners are arranged on a common imaginary projection line and another group will be arranged on another projection line which will be disposed at substantially equal angles in respect to a radius intersecting these lines. In a variation of this arrangement, the lining or covering bases of the individual groups are arranged on a projection line which forms an angle $+\beta$ in respect to a radial line and the other forms an angle $-\beta$. By precise arrangement of the explosive charge indentations, a doubling of the effective number of rows may be obtained.

The liner may be made with rotational symmetry in respect to the barb or projectile effects. Assuming equal sector angles between the casing generatrices on which the lining or covering bases are arranged with their centers to form rows, the impression angles $\alpha$ or $-\beta$ or $+\beta$ only have to be dimensioned so that the ratio of the angle $\alpha$ to the sector angle is of the order of 1:1 and the ratio of the angle $\beta$ to the sector angle is in the order of 1:2. It was found that the barbs or projectiles result in a detonation from linings or coverings with an impression angle $\alpha$ or $+\beta$ whose angle of departure is about half that of the respective impression angle in the direction under consideration.

The angles of departure of hollow charge barbs or projectiles can increase in a detonation in the end regions of the explosive charge in the direction of the longitudinal axis of the explosive charge by rarefaction waves or marginal shock waves. For this reason, it is sometimes advisable if at least the axis of the linings or coverings whose bases form the start and the end of the respective row form with the surface normals through the center of the respective lining or covering base an angle $\gamma$ varying the angle of departure in a plane extending through the center normals of the lining or covering bases of a row.

In a similar manner, the angle of departure of any barb or projectile can be influenced as desired in any row without great difficulties. For example, in order to make the distribution of the barbs or projectiles more uniform in a selected direction or to adapt the distances between the hollow charge barbs or projectiles following each other in a direction of the row to the distances between the hollow charge barbs or projectiles following each other transverse to the direction of the row. It is thus possible to vary the amount and sign of the individual impression angles corresponding to the respective purpose.

Accordingly, it is an object of the invention to provide an improved method of forming a hollow charge wherein impressions are formed into a plate in longitudinally extending and transversely extending rows with the impressions being of a precise geometrical form having center axes which are offset from the project centers in the next adjacent rows.

A further object of the invention is to provide a hollow charge liner which includes a plate having a multiplicity of impressions arranged in longitudinally and circumferentially extending rows, each impression having an indentation of a definite geometric form with the central axes of indentations in some rows being offset from the central axes of the indentations of others of said rows.

A further object of the invention is to provide a projectile lining construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
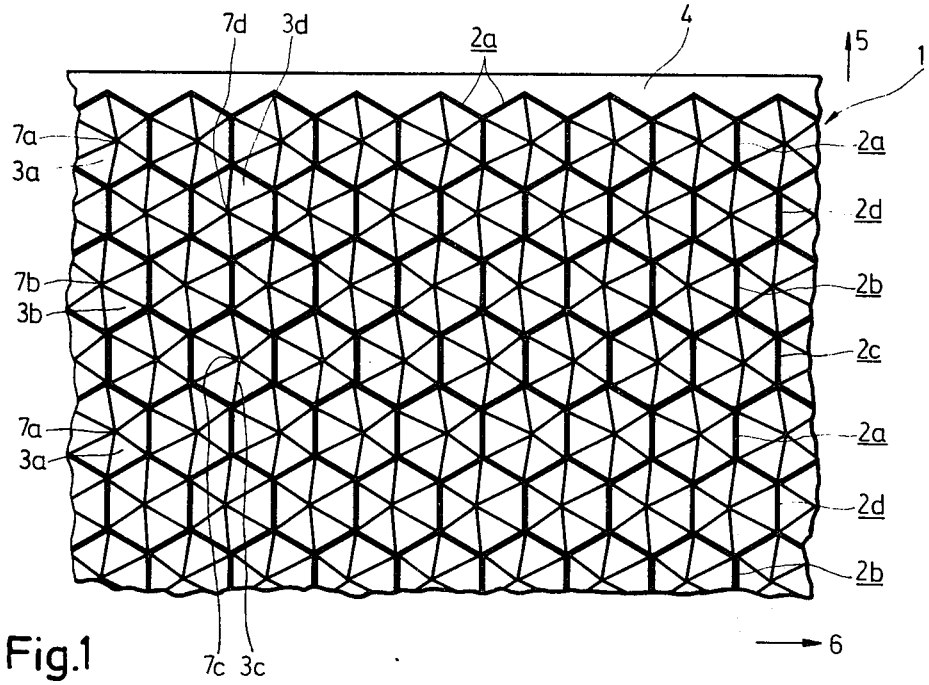
FIG. 1 is a development of a part of a casing for an explosive charge having hollow charge forming indentations thereon and constructed in accordance with the invention.

Referring to the drawings in particular, the invention embodied therein in FIG. 1, shows a hollow charge lining or casing 4 in a development view in which the longitudinal axes of the hollow charge will lie in the direction of the arrow 5 and the circumferential portion of the hollow charge will lie in the direction of the arrow 6.

In accordance with the invention, the casing 4 is formed with a multiplicity of indentations or hollow charge formations which include regular hexagons 2*a*, 2*b*, 2*c* and 2*d*. The hexagons form the bases of pyramid-shape impressions or coverings 3*a*, 3*b*, 3*c* and 3*d*. The coverings 3*a* to 3*d* are formed by pressing in a prefabricated casing 4 which has a circular cylindrical cross-section. In the preferred arrangement, the impressions are arranged in circumferential and longitudinally extending rows. The indentations are of precise geometrical form having central axes 7*a*, 7*b*, 7*c* and 7*d* for respective impressions 3*a*, 3*b*, 3*c* and 3*d*.

Figure 2:
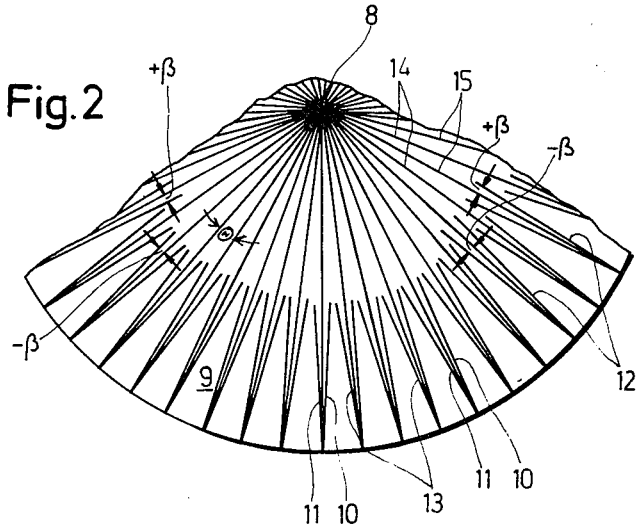
FIG. 2 is an axial view showing the axes of the projectile-forming coverings in a projection on a plane perpendicular to the longitudinal axis of the explosive charge having a casing constructed in accordance with the invention as shown in FIG. 1.

As can be seen in FIG. 2, in a projection of imaginary lines on a plane 9, which extends perpendicular to the longitudinal axis 8 of an explosive charge construction, similar to that shown in FIG. 1, the central axes 7*a* and 7*b* of the associated projectile-forming indentations 3*a* and 3*c* and which have bases 2*a* and 2*c*, respectively, lie on a straight line 10 and a straight line 12, respectively. Each straight line forms an angle $+\beta$ with a radially direction line 14 and 15 which intersects the imaginary line at the circumference. The axes 7*b* and 7*d* of the other group of indentations forming hollow charge lines 3*b* and 3*d* with bases 2*b* and 2*d* lie on a line 11 and 13, respectively, and these form an angle $-\beta$ in respect to the associated radial lines 14 and 15. The sector angles $\theta$ between the rows following each other in a circumferential direction of the bases 2*a* and 2*b*, 2*c* and 2*d* are of equal size and the ratio of the angle $\beta$ to the sector angle $\theta$ is in the order of 1:2.

The following numerical example illustrates the positive effect of a casing constructed in accordance with the FIGS. 1 and 2 in a warhead of 160.4 mm in diameter and 291 mm in length. The hollow charge liner indentations advantageously should have a width of 14mm in the circumferential direction 6.

The circumference of the warhead would be 504 mm. By dividing this circumference into individual hollow charge liners of 14 mm width, a maximum number of covering bases can be achieved in a tier or row perpendicular to the longitudinal axis of the warhead. This number would be 36. A total of 24 tiers or rows can be arranged on a given warhead length if the indentation bases are staggered as shown in FIG. 1. This has the result that 12 covering bases inside the honeycomb pattern, generally designated 1, form a row in the longitudinal direction of the casing and that a total of 72 such rows are formed. The sector angle $\theta$ in such a case would be 5°. If the axes of the projectile-forming indentations coincide with the sector angles inside each row with the radial ray extending through the center of their bases, the distance between the rows would be 1.74m in a detonation at a distance of 20 m from the detonation point with the indentations forming thorns or projectiles. However, if the axes of the respective indentations within each row of bases are provided, as shown in FIG. 2, alternately by angles of 2.5°, there is obtained on the basis of the previously mentioned relationships between the impression angle and the angle of departure between rows adjacent to the projectiles angle, differences of 2.5°, and thus, in a distance of 20m from the detonation point row, there would be intervals of only 0.87 m, which ensures a greater probability of hits.

If the explosive charge is detonated in the center in the warhead according to the numerical example, the projectiles formed from the individual linings or indentations have in an elevation direction, that is, in a direction of the longitudinal axis of the explosive charge, an elevation angle of about ±6° and hence, a total of 12°. In the longitudinal direction of the explosive charge, however, the 12 projectile-forming indentations form with their bases a row as described above. If the axes of the coverings coincide within such a row with the radial ray through their base center, the projectiles of a row would have an elevation angle of 1° assuming a uniformly distributed projectile departure in the detonation of the explosive charge. (maximum elevation angle of 12° divided by the number of indentations per row) However, since the axes are inclined, as mentioned above, the elevation angle per projectile in each row is not 1°, but 2°, with angle intervals between the rows of 2.5°, and this means practically a dense projectile distribution in the space around the respective warhead.

Figure 3:
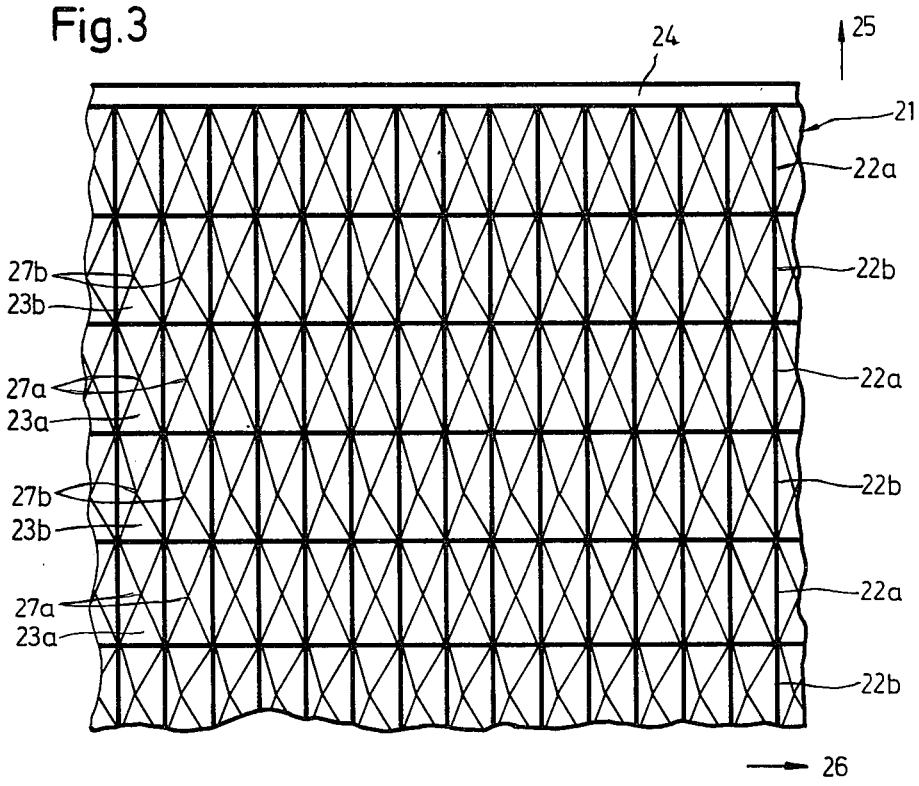
FIG. 3 is a view similar to FIG. 1 of another embodiment of the invention.
Figure 4:
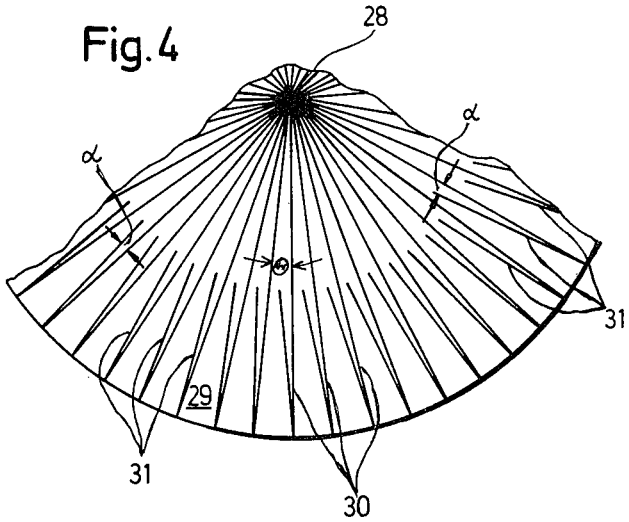
FIG. 4 is a view similar to FIG. 2 showing the arrangement in accordance with FIG. 3.

In the embodiment shown in FIG. 3, the casing is provided with indentations forming a chessboard pattern 21 with individual rectangles 22*a* and 22*b* representing bases of pyramid-shape charge linings 23*a* and 23*b*. Linings 23*a* and 23*b* are formed by impressing the liner indentations on a prefabricated casing 24 having a circular cylindrical cross-section. The arrow 25 indicates the longitudinal direction, and the arrow 26 indicates the circumferential direction. As best seen in FIG. 4, the hollow charge linings 23*a* and 23*b* which are formed have bases 22*a* and 22*b* which extend along a generatrix of the casing 24. In the projection on a plane 29 perpendicular to the longitudinal axis 28 of the explosive charge, the lining axes 27*a* of one of the charge linings 23*a* lie on the same line 30 as the radial rays through the centers of the lining bases 22*a* and 22*b* of both liner groups. A second line 31 forming with this line 30 and angle $\alpha$, is the geometric locus for the lining axes 27*b* of the other liner group 23*b*. It can be seen from FIG. 4 that the sector angles between the rows of lining bases 22*a* and 22*b* following each other in a circumferential direction are of an equal size and the ratio of the angle $\alpha$ to the angle $\theta$ is 1:1. The resulting advantages, including the doubling of the number of effective lining rows at the expense of the number of linings per row, are similar to that discussed in respect to the other embodiment.

Figure 5:
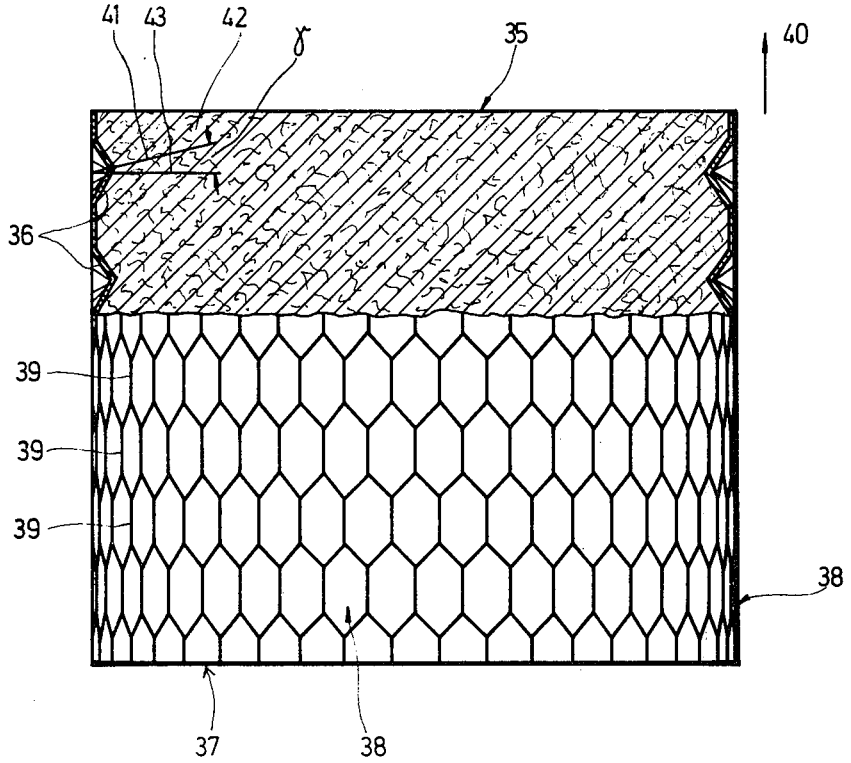
FIG. 5 is a partial elevational view and transverse sectional view of a warhead constructed in accordance with the invention.

In FIG. 5, there is indicated a warhead 35 having an explosive charge material 42 therein and it has a circular cylindrical cross-section outer covering or plate 37 which is completely transformed into individual plate charge coverings or liners 36. Liners 36, like the projectile-forming liners of FIGS. 1 and 2, have bases 39 forming a honeycomb pattern 38. The hexagonal honeycombs 38 have side walls which are elongated in a longitudinal direction 40. The axes of these plate charge liners 36 whose bases from a row in the longitudinal direction of the casing can assume positions in the projection on a plane perpendicular to the longitudinal axis of the explosive charge, as shown in FIGS. 2 and 4. The covering or lining axes of the embodiment, according to FIGS. 1 and 2, or FIGS. 2 and 4, can in turn form with the center normal to the associated liners or lining base, an angle $\gamma$, as shown in FIG. 5 is respect to the plate liner axis 41 in order to influence the spreading effect in the longitudinal direction of the casing in the plane extending through the center normal 43 of the respective row of bases 42 (diametral plane). The size and the sign of the angles $\gamma$ depend on the respective purpose.

While specific embodiments of the invention have been shown and described in detail to illustrate the application of the principles of the invention, it will be understood that the invention may be embodied otherwise without departing from such principles.

What is claimed is:

1. A method of forming a hollow charge lining for a hollow charge, comprising forming into a plate a multiplicity of multi-sided closed-form geometric impressions extending inwardly into said plate from all of the sides of each impression to an innermost geometrical axis point and arranged in longitudinally extending and transversely extending rows, and wherein the impressions of at least some of said rows are formed with geometrical axis points which are offset from the axis points of the other of said rows.

2. A method according to claim 1, wherein each of the impressions are of hexagonal form and include a geometrical impression within the hexagonal form forming the axis points which are offset from some rows in respect to other rows, the axis points of some of said rows being arranged along an imaginary first projection line in a plane normal to the longitudinal axis points of the hollow charge and the axes of others of said charges being arranged along a second imaginary projection line disposed at an angle to said imaginary projection line, each of said first and second projection lines making an angle with a radial line intersecting said imaginary line and wherein adjacent pairs of rows have radial lines therebetween defining a sector angle which is substantially double the angle between said imaginary line and the associated radial line.

3. A method according to claim 1, wherein the individual impressions comprise rectangular liners impressed into said plate and with the axis points of said impressions being offset in alternate rows, the axis points of some of said rows being along a radial line in an imaginary projection at right angles to the axis of said charge and the axis of the other of said rows being along an imaginary line disposed at an angle to said radial line.

4. A method according to claim 1, wherein the impressions are formed in the form of a honeycomb pattern with individual hexagonal liner portions impressed inwardly to said axis points.

5. A hollow charge lining comprising a plate having an exterior wall formed with a multiplicity of inwardly pressed formations thereon arranged in longitudinally and circumferentially extending rows, each impression defining a hollow charge liner portion comprising an indentation of a definite geometric multisided closed form having a surrounding base and extending inwardly of said plate from all of the sides of the base to an innermost point defining an axis point, the axes points of some of the indentations in a longitudinal row being offset from those of other indentations in a longitudinal row.

6. A hollow charge lining, according to claim 5, wherein axis point of each inwardly pressed formation in a row has a different location than the axial direction of the axis point of the next adjacent row.

7. A hollow charge lining, according to claim 5, wherein each formation has a peripherally extending base portion of a definite geometric outline and an inwardly pressed portion forming a lining with said axis point, the axis points of the linings in a row being arranged in groups corresponding to the alignment of their axis points, the axis points of different groups being offset.

8. A hollow charge lining, according to claim 5, wherein the axis points of alternately arranged formations in each longitudinal row are diposed in a first imaginary projection line in a plane at right angles to the longitudinal axis of the explosive charge and the axis points of the others of said formations are arranged along a second imaginary line disposed at an angle to the first imaginary line and wherein each of the imaginary lines is disposed at an angle in respect to a radial line intersecting said imaginary lines.

9. A hollow charge lining, according to claim 8, wherein the angle between said one of said imaginary lines and the adjacent radial line in respect to the sector angle between centers of adjacent longitudinal rows is in the order of 1:1 with cylindrical charge cross-sections and equal sector angles between those generatrices on the surface of said plate.

10. A hollow charge lining according to claim 5, wherein said formations forming said liners are rectangular and wherein the axis point of the indentation of adjacent formations in a longitudinal row are offset with the center axes of alternate rows being arranged along a radial line and with the axis point of the adjacent rows being arranged along a line disposed at an angle to the radial line.

11. A hollow charge according to claim 5, wherein the formations of each horizontal row have axis points which are offset in a radial direction from the next adjacent horizontal row.

12. A hollow charge according to claim 5, wherein the formations include bases around their peripheries and have axis points with axial angles which are different.

13. A hollow charge construction comprising an explosive material, a cylindrical liner formed around said material, said liner having a multiplicity of indentations thereon defined in longitudinal and circumferentially arranged rows, each of said indentations having sides forming a closed form and extending inwardly of said liner from all sides to an innermost axis point, the axis points of some of said indentations in a longitudinal row being offset from others.

* * * * *